US006974301B2

(12) United States Patent
Suzuki et al.

(10) Patent No.: US 6,974,301 B2
(45) Date of Patent: Dec. 13, 2005

(54) SELF PRIMING REGENERATIVE PUMP

(75) Inventors: Hiroaki Suzuki, Shizuoka (JP); Isamu Uchiumi, Shizuoka (JP)

(73) Assignee: Nikkiso Co., Ltd., Tokyo (JP)

( * ) Notice: Subject to any disclaimer, the term of this patent is extended or adjusted under 35 U.S.C. 154(b) by 327 days.

(21) Appl. No.: 10/412,487

(22) Filed: Apr. 11, 2003

(65) Prior Publication Data

US 2004/0009058 A1 Jan. 15, 2004

(30) Foreign Application Priority Data

Jul. 11, 2002 (JP) ..... 2002-203070

(51) Int. Cl.[7] ..... F04D 9/02

(52) U.S. Cl. ..... 415/55.1; 415/56.1; 415/56.4; 415/169.1

(58) Field of Search ..... 415/55.1, 56.1, 415/56.4, 169.1; 417/199.2

(56) References Cited

U.S. PATENT DOCUMENTS 2,006,590 A * 7/1935 Ferguson ..... 415/56.1
3,649,131 A * 3/1972 Hagemann ..... 415/55.1
5,160,249 A * 11/1992 Iwai et al. ..... 415/55.3

FOREIGN PATENT DOCUMENTS

EP 1 199 477 A2 4/2002
JP 06-330880 A 11/1929
JP 07-167084 A 7/1995
JP 2002-257071 9/2002

OTHER PUBLICATIONS

Patent Abstract of Japan for JP 2002–257071 published on Sep. 11, 2002.
Patent Abstracts of Japan for JP06–330880 published Nov. 29, 1994.
Patent Abstracts of Japan for JP07–167084 published Jul. 4, 1995.

* cited by examiner

*Primary Examiner*—Ninh H. Nguyen
(74) *Attorney, Agent, or Firm*—Darby & Darby

(57) ABSTRACT

A self priming regenerative pump comprising an impeller with a plurality of vanes formed on its periphery, casings 1*a* and 1*b* which house said impeller in a rotatable manner and a pressurizing passage consisting of a gap between said casing and the outer periphery of said impeller, further comprising: a small diameter part formed at a position communicating with pressurizing passage of a discharge flow passage, in particular, formed smaller than the diameter of a discharge port; and; a passage for communicating between discharge port side of smaller diameter part of discharge flow passage and pressurizing passage in order to allow the fluid in discharge flow passage to return to pressurizing passage, wherein said position communicating with pressurizing passage is outwardly offset from the center of the width of impeller.

9 Claims, 5 Drawing Sheets

SELF PRIMING REGENERATIVE PUMP

FIELD OF THE INVENTION

The invention relates to a self priming regenerative pump which is capable of discharging gasses mixed in the induced fluid.

DESCRIPTION OF THE RELATED ART

A conventional self priming regenerative pump primarily consists of an impeller with a plurality of vanes formed on its periphery, a casing which houses said impeller in a rotatable manner and is equipped with a suction port for sucking a fluid and a discharge port for discharging the fluid formed thereon, and a pressurizing passage consisting of a gap between said casing and the outer periphery of said impeller. The pump sucks a fluid via the suction port, guides it through the pressurizing passage and discharges it via the discharge port by means of rotating the impeller while the casing is filled with the fluid.

It is considered that fluid vortices develop between the vanes formed on the outer periphery of the impeller in such a self priming regenerative pump, thus causing a desirable discharge of the fluid helped thanks to said vortices. However, if too much gas exists in the fluid sucked through the suction port, the gasses remain in the gaps between vanes and may prevent a desirable formation of vortices, thus affecting the pump function.

In order to prevent such a problem, self priming regenerative pumps have been proposed such as the one disclosed by Publication of Unexamined Japanese Patent Application 6-330880. Such a self priming regenerative pump is equipped with a gas-liquid separation tank of a specific capacity provided on the discharge port side, so that the gasses mixed with the liquid can be separated by means of the gas-liquid separation tank to be expelled from the pump.

However, said self priming regenerative pump of the prior art has a problem that it requires the installation of a gas-liquid separation tank of a specified capacity on the discharge port side, which makes the pump unit larger. It also has another problem that the gas-liquid separation tank causes bacteria breeding as it is always filled with liquid and tank maintenance, such as cleaning and disinfection, is difficult to perform. Therefore, it is difficult to use such a pump for medical devices such as a dialysis device, in which it is mandatory to maintain a hygienic condition, thus limiting its scope of application.

Another self priming regenerative pump is disclosed in Publication of Unexamined Japanese Patent Application H7-167084. Such a self priming regenerative pump is equipped with a cross-shaped gas-liquid separator installed in the flow passage on the discharge side in order to elicit the gasses contained in the liquid on the discharge side by rectifying the flow by means of said gas-liquid separator, so that the gasses can be removed.

However, the elicitation of gasses by means of said cross-shaped gas-liquid separator is far from perfect, with the gas expelling capacity being still insufficient, and sometimes causes an airlock in the pump when a large amount of gasses is mixed in the liquid, thus making the pump unusable.

The present invention is made under such a circumstance, and is intended to provide a self priming regenerative pump that does not need a gas-liquid separating tank, and can suppress problems such as airlocks even when there is a large amount of gasses contained in the liquid.

SUMMARY OF THE INVENTION

The invention described in claim 1 is a self priming regenerative pump comprising: an impeller with a plurality of vanes formed on its periphery; a casing which houses said impeller in a rotatable manner and is equipped with a suction port for sucking a fluid and a discharge port for discharging the fluid formed thereon; a pressurizing passage consisting of a gap between said casing and the outer periphery of said impeller; a suction flow passage extending from said suction port to said pressurizing passage in order to induce the fluid into said casing; and a discharge flow passage extending from said pressurizing passage to the discharge port and further extending upwardly in the radius direction of said casing in order to discharge the fluid that has passed through the pressurizing passage in said casing, characterized in further comprising: a small diameter part formed at a position communicating with the pressurizing passage of said discharge flow passage, in particular, formed smaller than said discharge port's diameter; and; a passage for communicating between said discharge port side of said smaller diameter part of said discharge flow passage and said pressurizing passage in order to allow the fluid in said discharge flow passage to return to said pressurizing passage, wherein said position communicating with said pressurizing passage is outwardly offset from the center of the width of said impeller.

With such a constitution, the liquid flows through both the communicating passage and the small diameter part and is discharged from the discharge port during the normal operation, while the liquid flows only through the small diameter part and the liquid returns through the communication passage to the pressurizing passage when a lot of gasses is mixed in the liquid. The liquid, after passing through the small diameter part, reduces its flow speed and pressure, so that smaller bubbles unite, increasing their buoyancies, and move upward more quickly to be discharged from the discharge port.

The invention described in claim 2 is a self priming regenerative pump described in claim 1 wherein, discharge port side cross section of said pressurizing passage is formed smaller than cross sections in other parts of said pressurizing passage.

The invention described in claim 3 is a self priming regenerative pump described in either claim 1 or claim 2 wherein, said communication passage has a larger inner diameter than that of said small diameter part.

The invention described in claim 4 is a self priming regenerative pump described in claim 3 wherein, the ratio between the cross sections of said communication passage and the small diameter part is larger than 2:1, or preferably 5:1.

The invention described in claim 5 is a self priming regenerative pump described either one of claim 1 through claim 4, wherein said communication passage and small diameter part consist of end-milled holes on said casing.

DETAILED DESCRIPTION OF THE PREFERRED EMBODIMENTS

Figure 1:
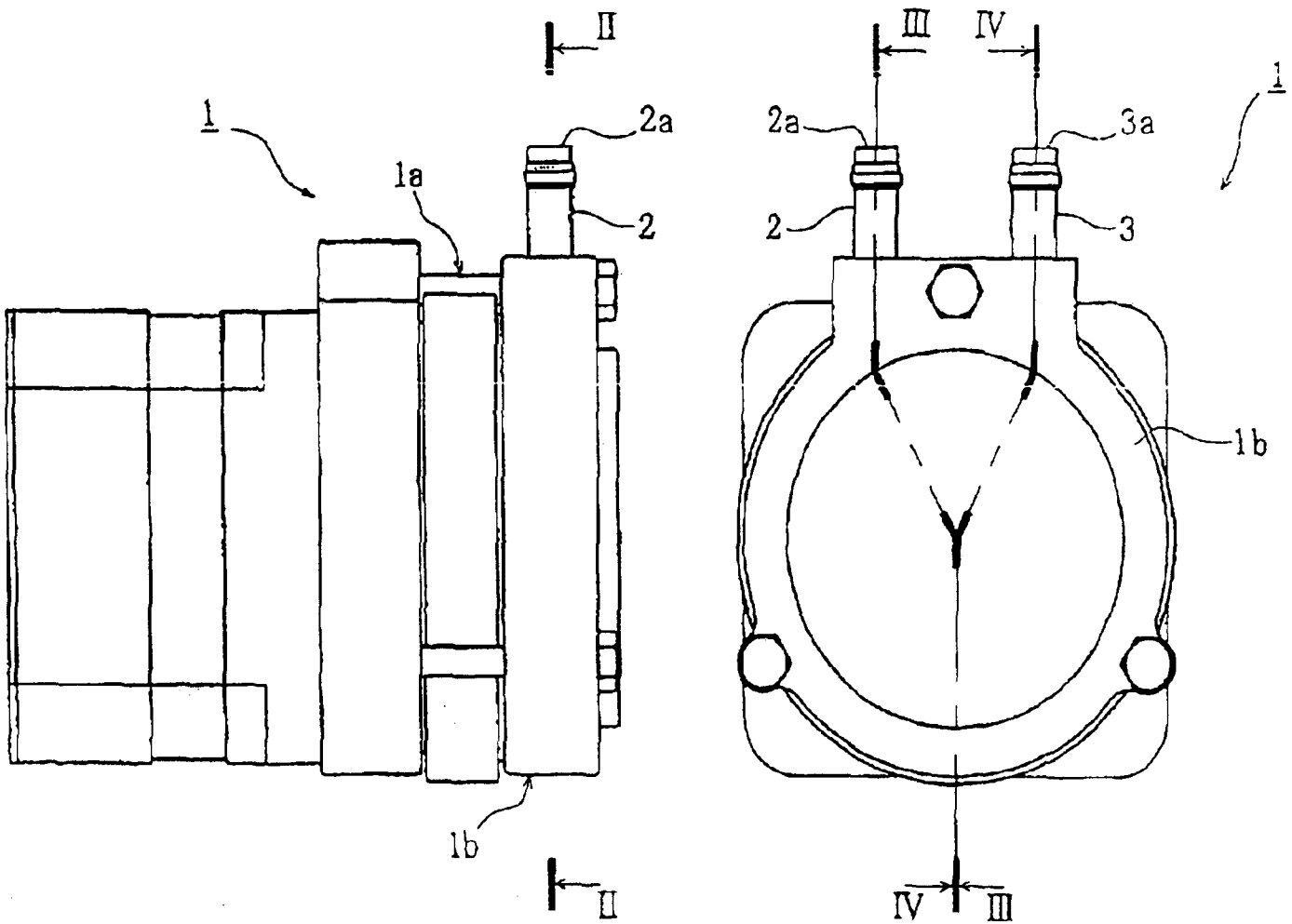
FIG. 1 is a left side view and front view of a self priming regenerative pump according to an embodiment of the invention.

A preferred embodiment of the invention will be described below referring to the accompanying drawings. The self priming regenerative pump according to an embodiment of the invention is cable of relieving gasses mixed in the induced liquid without recourse to a gas-liquid separation tank of a specified capacity, and consists of a rear casing 1*a* and a front casing 1*b* as shown in FIG. 1 from the standpoint of its external appearance.

Figure 3:
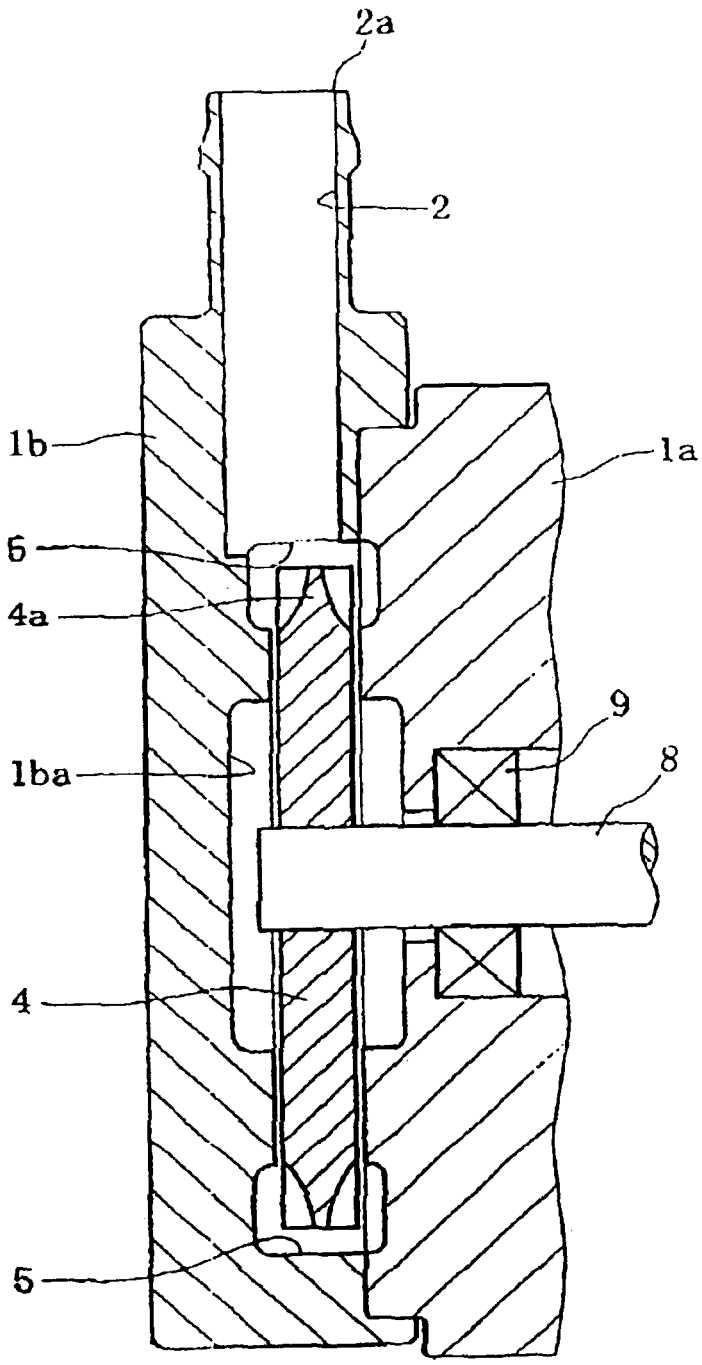
FIG. 3 is a cross section along III—III line of FIG. 1.

Rear casing 1 a houses a drive means such as an electric motor (not shown), and its output shaft 8 of the drive means sticks out and extends into front casing 1*b* as shown in FIG. 3. Said output shaft 8 is provided with a shaft seal 9 for preventing the liquid to leak outside, and its end extends into a cavity 1*ba* formed in front casing 1*b*.

In the upper portion of front casing 1*b* has a suction flow passage 2 and a discharge flow passage 3 formed extending upward substantially in parallel with each other, and the openings of these suction flow passage 2 and discharge flow passage 3 constitute a suction port 2*a* and a discharge port 3*a* respectively. These suction flow passage 2 and discharge flow passage 3 are both communicating with a pressurizing passage 5 provided in front casing 1*b* so that the liquid flowing in via suction port 2*a* can reach pressurizing passage 5 via suction flow passage 2 to be discharged through discharge flow passage 3 and discharge port 3*a*.

In the meanwhile, an impeller 4, having a plurality of vanes 4*a* provided on its periphery, is affixed in the vicinity of the distal end of output shaft 8, and said impeller 4 is rotatable freely inside front casing 1*b*. In other words, when output shaft 8 is driven by a drive means, impeller 4 rotates inside the casing. Vanes 4*a* are formed at a constant interval along the entire range of outer periphery of impeller 4.

Gaps of specified dimensions are provided on the outer periphery of impeller 4 (i.e., the edge of vanes 4*a*) as well as both sides of vanes 4*a*, and those gaps constitute pressurizing passage 5. A portion of pressurizing passage 5 on the discharge flow passage 3 side has gaps with dimensions smaller than the abovementioned dimensions, making their cross sections (of the liquid passages) smaller than those in other parts of said pressurizing passage 5. A narrowed part 5*a* having smaller gap dimensions should preferably be formed for a range of an angle $\alpha$ (e.g., 30–40°).

Suction flow passage 2 and discharge flow passage 3 are extending upwardly in the radius direction of impeller 4 and their distal ends (upper ends) are constituting suction port 2*a* and discharge port 3*a* respectively, while their proximal ends (bottom ends) are communicating with pressurizing passage 5. In other words, suction flow passage 2 and discharge flow passage 3 are formed in such a way that their proximal ends are opposing the outer periphery of impeller 4, so that the liquid introduced from said suction flow passage 2 enters the spaces between adjacent vanes 4*a* and is directly guided toward discharge flow passage 3 through pressurizing passage 5.

Figure 2:
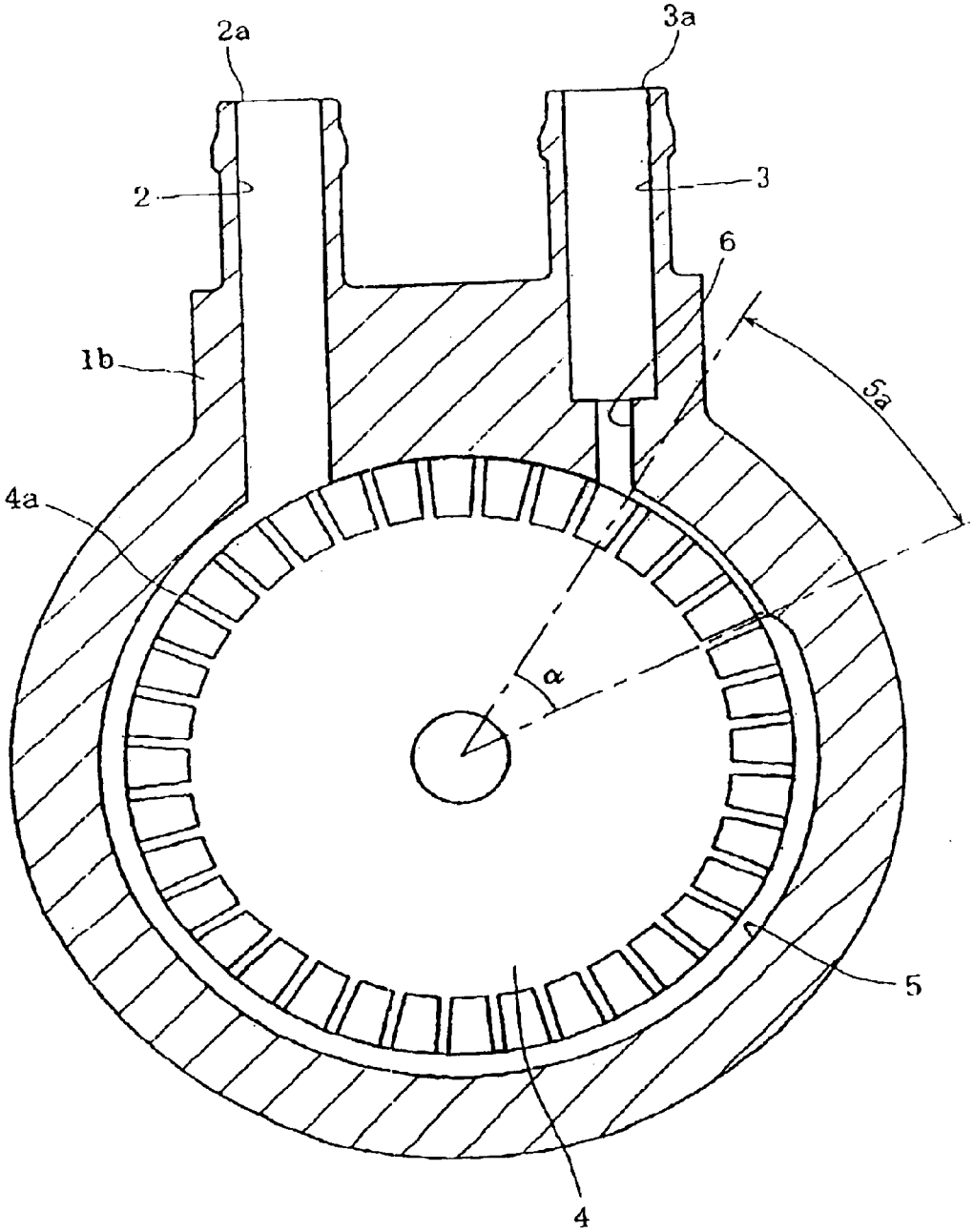
FIG. 2 is a cross section along II—II line of FIG. 1.
Figure 4:
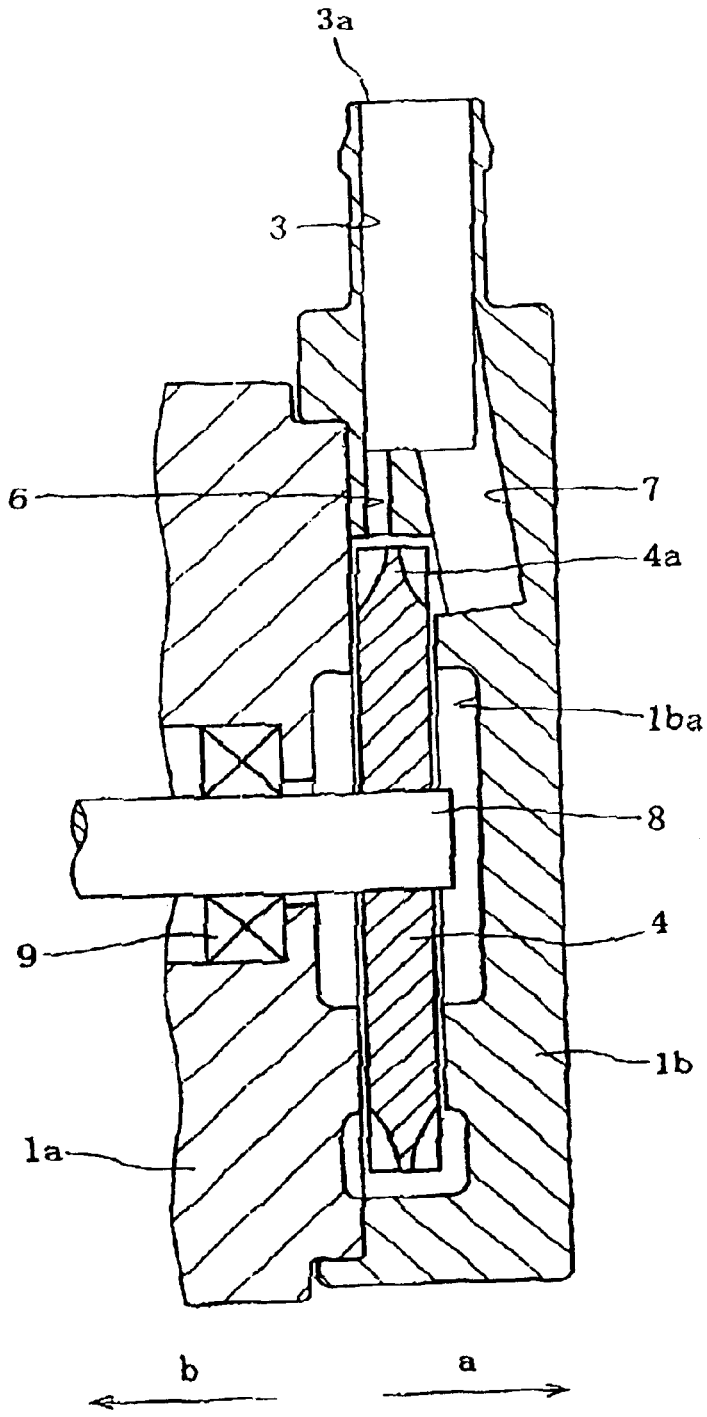
FIG. 4 is a cross section along IV—IV line of FIG. 1.

As shown in FIG. 2 and FIG. 4, a small diameter part 6 (orifice) having a inner diameter smaller than the diameter of discharge port 3*a* is formed at a position communicating with pressurizing passage 5 of discharge flow passage 3. By having such a small diameter part 6, following operation effects are available. When the liquid, having passed small diameter part 6, reaches discharge flow passage 3 having a larger diameter, its flow speed and pressure drop, so that smaller bubbles unite, increasing their buoyancies, and move upward more quickly to be discharged from discharge port 3*a*.

Thus, it is possible to get rid of gasses mixed in the liquid through discharge port 3*a* without having to have a gas-liquid separation tank of a specified capacity as in the prior art. Consequently, the total size of the pump can be reduced by the amount of the gas-liquid separation tank and the retention of liquid in the tank can be eliminated, making it possible to be applied to devices that require rigorous hygienic controls, such as a dialysis device.

Moreover, in this embodiment, a communication passage 7 is formed for allowing the liquid in said discharge flow passage 3 to be returned to pressurizing passage 5 by means of communicating pressurizing passage 5 with discharge flow passage 3 on the discharge port 3*a* side of small diameter part 6 (i.e., upper side of small diameter part 6) as shown in FIG. 4. The position of communicating passage 7 communicating with pressurizing passage 5 is offset toward outside (direction "a" in the drawing) of the center of impeller 4 in the width direction so that the returning liquid is guided from the front side of impeller 4.

It is also possible to constitute in such a way that the position that communication passage 7 communicates with pressurizing passage 5 to be offset in the "b" direction shown in the drawing (such a direction is also on the outside of the center of impeller 4 in the width direction), so that the returning liquid is introduced from the backside of impeller 4. Communication passage 7 has an inner diameter larger than that of small diameter part 6, and the ratio of the cross sectional area between communication passage 7 and small diameter part 6 should be 2 to 1 or larger, or more preferably, 5 to 1.

Figure 5:
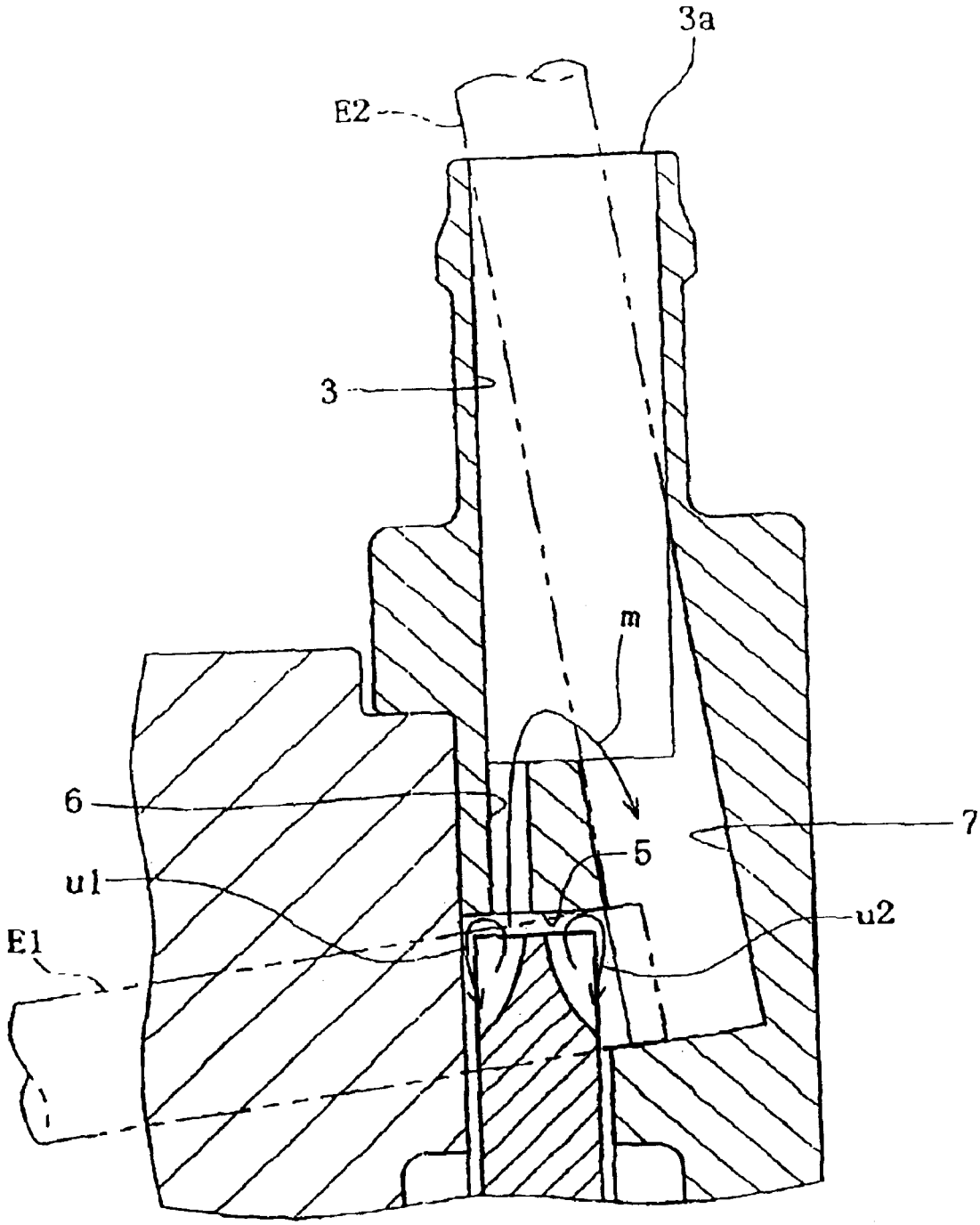
FIG. 5 is an enlarged cross sectional view showing the discharge flow passage and the flow in its vicinities in the self priming regenerative pump according to the embodiment of the invention.

Communicating passage 7 consists of a hole end-milled by an end-mill E2 extending downward from discharge flow passage 3, and a hole end-milled by an end-mill E1 extending sideway from pressurizing passage 5 as shown in FIG. 5. As communication passage 7 is formed by milling front casing 1*b*, communication passage 7 resides completely inside said front casing 1*b*, thus contributing to making the entire pump more compact compared to those with communication passages formed outside of front casing 1*b*. The tool used for forming the passage is not limited to an end-mill, but can be any other suitable means (e.g., grinder).

Next, the operation of self priming regenerative pump 1 constituted as describe above.

First, fill the casing (especially, cavity 1*ba* of front casing 1*b*) with the liquid, supplying it from suction port 2*a* or discharge port 3*a*. When it is filled with the liquid, starts the drive means to rotate output shaft 8 and the impeller 4 to generate suction force to suck the liquid through suction port 2*a*.

The liquid sucked through suction port 2*a* reaches pressurizing passage 5 through suction passage 2 and is guided toward discharge port 3*a* due to the rotating action of impeller 4. In said process, the liquid being introduced passes through pressurizing passage 5 being carried in a gap between a vane 4*a* and an adjacent vane 4*a* formed on the outer periphery of impeller 4.

After passing narrow part 5*a* of pressurizing passage 5, the liquid is divided into one flow that goes through small diameter part 6 of discharge flow passage 3 and another flow that goes through communicating passage 7, which meet again in the upper section to be discharged through discharge port 3*a*. As a result of these actions, the liquid sucked through suction port 2*a* is discharged through discharge port 3*a*, allowing the pump to perform its intended function.

In order for the liquid to be pushed out from pressurizing passage 5 to discharge flow passage 3 efficiently, vortices u1 and u2 are needed between vanes 4*a* as shown in FIG. 5. While the liquid existing between vanes 4*a* is pushed out nicely toward discharge flow passage 3 thanks to the actions of vortices u1 and u2, vortices u1 and u2 die down if a lot of gasses exists in the liquid sucked through suction port 2*a*, thus weakening the gas purging action.

The present embodiment is capable of maintaining a good gas purging capability even when the liquid between vanes 4*a* is reduced due to a large amount of gasses existing in the liquid. More specifically, when a large amount of gasses exist in the liquid, the liquid that comes out of pressurizing passage 5 goes only through small diameter part 6 so that the gasses mixed in the liquid become elicited (conglomerated) and increase buoyancies, thus to be discharged quickly through discharge port 3*a*.

This is due to the fact that, when the amount of the liquid reduces due to a large amount of gasses in the liquid-gas mixture existing between vanes 4*a*, the liquid flows in the direction toward small diameter 6 rather than toward communication passage 7, which is offset from the radial direction, as the centrifugal force generated by the rotation of impeller 4 is transmitted most efficiently in the radial direction of impeller 4. Moreover, since communicating passage 7 is communicating with the front side of impeller 4, the liquid returning through said communicating passage 7 can easily enter into pressurizing passage 5.

After passing through small diameter part 6, the liquid returns again to pressurizing passage 5 via communicating passage 7 (the flow coded as "m" in FIG. 5), so that the liquid between vanes 4*a*, which has a low content of liquid, is replenished with the liquid (after the gasses are purged) and generates vortices u1 and u2 more efficiently. Moreover, as a vane 4*a* enters the area of narrow part 5*a*, the volume consisting of the space between vanes 4*a* and pressurizing passage 5 reduces so that the space between said vanes 4*a* will be filled with liquid even when the liquid between vanes 4*a* originally has a low content of liquid, which will also contribute to more active generation of vortex u1 in particular.

As shown in FIG. 5, since the bottom end of small diameter part 6 is located above the point where vortex u1 is generated, the liquid is introduced into small diameter 6 primarily by the left side vortex, i.e., u1 among vortices u1 and u2, so that even a small amount of liquid causes a good push out action toward discharge flow passage 3. On the other hand, the liquid is introduced from communicating passage 7 to the position where vortex u2 is generated, so that vortex u2 is also efficiently generated.

Due to the actions described above, sufficient vortices u1 and u2 are generated to facilitate efficient discharge of the liquid and quick purging of the gasses at the same time even if a large amount of gasses exists mixed with the liquid and the liquid content contained in the space between vanes 4*a* is small. During a normal operation (when a large amount of gasses are not contained in the liquid), the liquid does not return through communicating passage 7 and communicating passage 7 serves as a flow passage simply for guiding the liquid toward discharge port 3*a*.

Consequently, the present embodiment enables to prevent problems such as airlock without recourse to the use of a gas-liquid separation tank, even when a large amount of gasses exist mixed in the liquid, as the liquid passes through small diameter part 6 and is returned to pressurizing passage 5 after purging the gasses Although a preferred embodiment is described in the above, the invention is not limited by it in any means. For example, similar effects can be achieved by providing a plurality of communication passages 7 to make it possible to return a large amount of liquid, or by providing a plurality of small diameter parts 6. Moreover, communicating passage 7 suffices its objective if its position of communication with the pressurizing passage is offset toward the outer side of the center of impeller 4 in the width direction, and other parts may be formed substantially parallel with discharge flow passage 3 including small diameter part 6.

Moreover, although a narrow part 5*a* is formed on the discharge flow passage 3 side of pressurizing passage 5 in the present embodiment in order to make it easier to guide a smaller amount of the liquid to small diameter part 6, it is also possible to do without a small diameter part 6 and form pressurizing passage 5 entirely with a uniform dimension.

The invention described in claim 1 suppresses problems such as airlock without recourse to the use of a gas-liquid separation tank, even when a large amount of gasses exist mixed in the liquid, as the liquid passes through the small diameter part and is returned to the pressurizing passage after purging the gasses The invention described in claim 2 guides even a small amount of liquid to the small diameter part and to the discharge port securely even when a large amount of gasses exists in the liquid, as the cross-sectional area of the discharge side of the pressurizing passage is formed smaller than those of other areas. Therefore, it securely suppresses problems such as airlock more securely.

The inventions described in claim 3 and claim 4 provide a communication passage with an inner diameter larger than that of the small diameter part, thus making it possible to improve the flow of the liquid during a normal operation, while making it possible to return a larger amount of liquid on the discharge port side when a large amount of gasses exists in the liquid.

The invention described in claim 5 provides the communicating passage and the small diameter part formed by milling in the inside of the casing, thus minimizing the number of parts, minimizing the manufacturing cost, and simplifying the maintenance work.

Codes Used on the Drawings

1 Self priming regenerative pump
1*a* Rear casing
1*b* Front casing
1*ba* Cavity
2 Suction flow passage
2*a* Suction port
3 Exhaust flow passage
3*a* Exhaust port
4 Impeller
4*a* Vane
5 Presurizing passage
5*a* Narrow part
6 Small diameter part
7 Communicating passage
8 Output shaft
9 Shaft seal

What is claimed is:

1. A self priming regenerative pump comprising:

an impeller with a plurality of vanes formed on a periphery, of said impeller;

a casing housing said impeller in a rotatable manner and is equipped with a suction port for sucking a fluid and a discharge port for discharging the fluid formed thereon;

a pressurizing passage consisting of a gap between said casing and an outer periphery of said impeller;

a suction flow passage extending from said suction port to said pressurizing passage to induce the fluid into said casing;

a discharge flow passage extending from said pressurizing passage to the discharge port and further extending upwardly in a radical direction of said casing to discharge the fluid that has passed through the pressurizing passage in said casing, said discharge flow passage:

a small diameter part formed at a position communicating with the pressurizing passage of said discharge flow passage, in particular, formed smaller than a diameter of said discharge port; and;

a passage for communicating between said discharge port side of said smaller diameter part of said discharge flow passage and said pressurizing passage allow the fluid in said discharge flow passage to return to said pressurizing passage, wherein said position communicating with said pressurizing passage is outwardly offset from the center of the width of said impeller.

2. A self priming regenerative pump described in claim 1 wherein, a side cross section of same discharge port of said pressurizing passage is formed smaller than a cross section of said pressurizing passage.

3. A self priming regenerative pump described in claim 2, wherein said communication passage comprises an inner diameter than that of said small diameter part.

4. A self priming regenerative pump described in claim 2, wherein;

said communication passage and small diameter part consist of end-milled holes on said casing.

5. A self priming regenerative pump described in claim 1, wherein said communication passage comprises an inner diameter large than that of said small diameter part.

6. A self priming regenerative pump described in claim 5 wherein, the ratio between the cross sections of said communication passage and small diameter part is larger than 2:1, or preferably 5:1.

7. A self priming regenerative pump described in claim 6, wherein;

said communication passage and small diameter part consist of end-milled holes on said casing.

8. A self priming regenerative pump described in claim 5, wherein;

said communication passage and small diameter part consist of end-milled holes on said casing.

9. A self priming regenerative pump described in claim 1, wherein;

said communication passage and small diameter part consist of end-milled holes on said casing.

* * * * *